United States Patent [19]

Kenney

[11] 4,446,640

[45] May 8, 1984

[54] PRICE TICKET AND LIKE DISPLAYS

[75] Inventor: George H. W. Kenney, Wimbledon, England

[73] Assignee: Richard Kenney, Toronto, Canada

[21] Appl. No.: 349,870

[22] Filed: Feb. 18, 1982

[51] Int. Cl.[3] ..... G09F 3/18

[52] U.S. Cl. ..... 40/16.2; 40/615; 40/618

[58] Field of Search ..... 40/615, 618, 16, 16.6, 40/16.4, 16.2, 1.5, 1.6, 490, 491, 575, 600, 611, 40/10 D, 10 R, 594; 434/368, 370, 81, 428; 46/233

[56] References Cited

U.S. PATENT DOCUMENTS

| | | | |
|---|---|---|---|
| D. 265,083 | 6/1982 | Divoky | 40/10 R |
| 1,711,170 | 4/1929 | Chancey | 40/16.2 |
| 2,172,528 | 9/1939 | Auer | 40/618 |
| 2,441,002 | 5/1948 | Berglund | 40/2 R |
| 2,586,039 | 2/1952 | Heggedal | 46/233 |
| 3,707,792 | 1/1973 | Mabrey et al. | 40/575 |
| 3,797,147 | 3/1974 | Lemberg | 40/615 |
| 3,849,913 | 11/1974 | Williams, Sr. | 40/594 |
| 4,334,372 | 6/1982 | Colmar | 40/16.2 |

*Primary Examiner*—Gene Mancene
*Assistant Examiner*—Cary E. Stone
*Attorney, Agent, or Firm*—Emory L. Groff, Jr.

[57] ABSTRACT

A merchandise pricing ticket assembly has a rigid highly polished plastic material forming a support panel which is printed with display matter and has areas left clear to form windows. Components of a soft flexible material, also highly polished, are provided which adhere to the rear of the windows whereby information on the components may be viewed therethrough. A setting panel is provided enabling the components to be laid out in their correct relative position before the support panel is laid thereover to pick-up the components. The support panel is thereafter retained in a channeled shelf fixture.

5 Claims, 11 Drawing Figures

Figure 1:
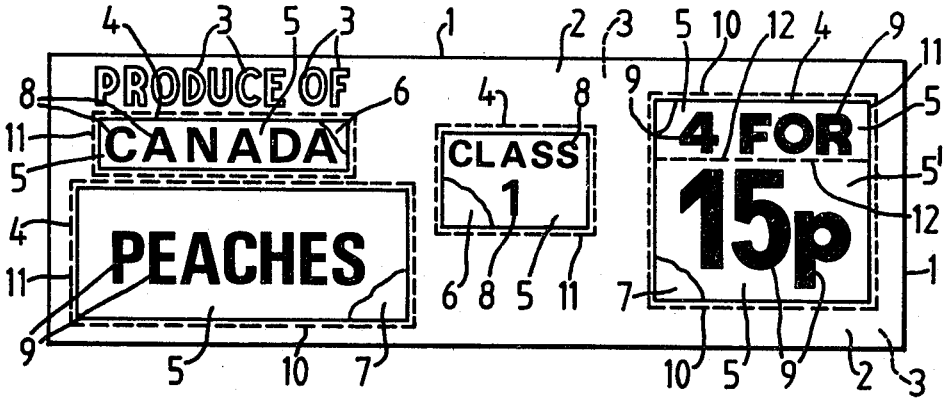

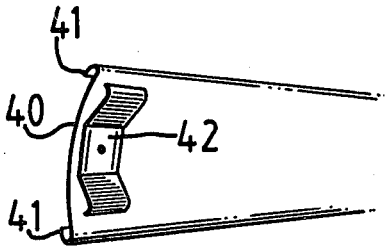
FIG. 4.
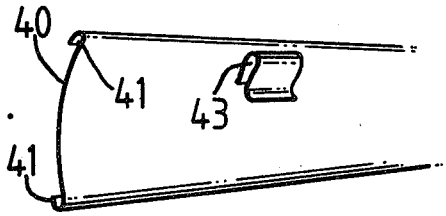
FIG. 5.
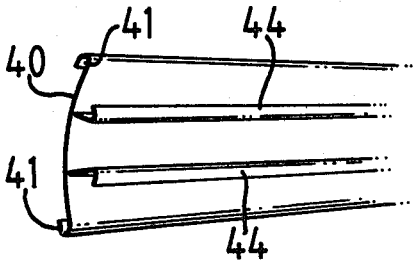
FIG. 6.
FIG. 7.
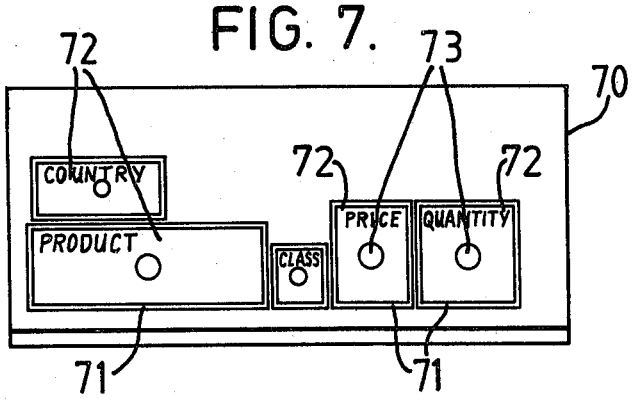

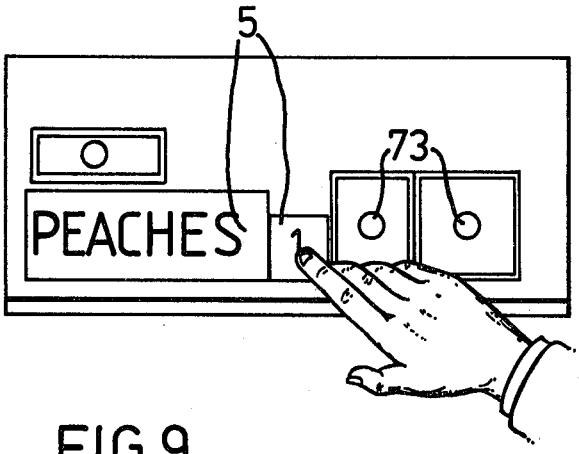
FIG. 8.
FIG. 9.
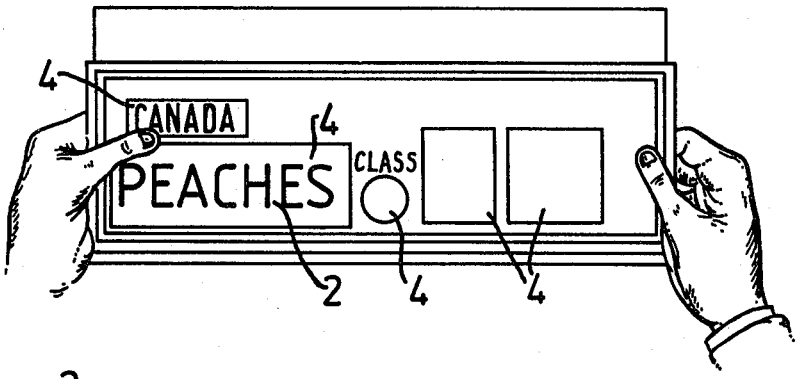
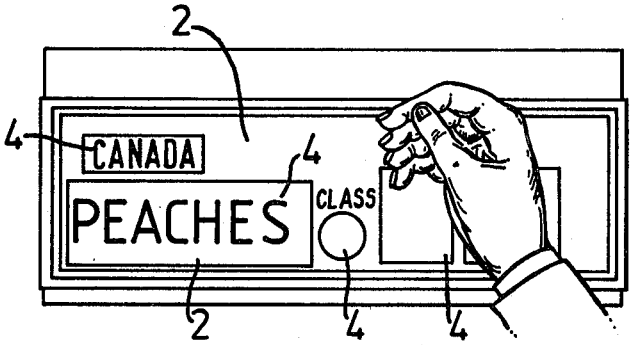
FIG. 10.
FIG. 11.
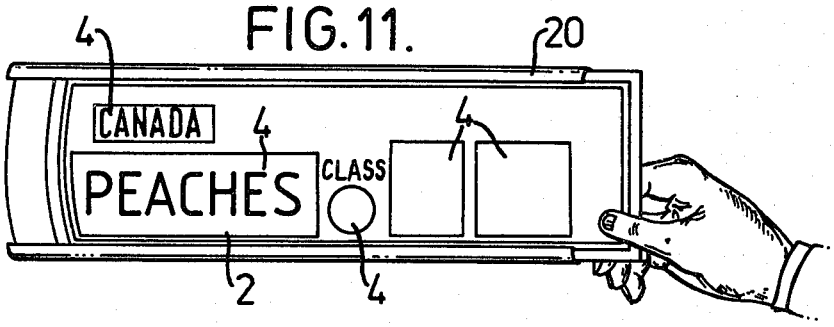

PRICE TICKET AND LIKE DISPLAYS

This invention relates to price ticket and like displays of strip form which can be flexed and sprung into the opposed jaws of a channelled ticket-holder such as those used for shelf-pricing.

One object of this invention is to provide a display wherein certain numerals and parts, or even the whole, of the subject matter displayed on the ticket can be rapidly and easily changed whilst still providing the appearance of an integral, or one piece, ticket unit when assembled and put on display.

A further object is to provide a ticket protected against interference and appearing to have been printed or signwritten, as a single unit.

Another object is to provide a means for setting up a ticket from components which is simple and easily produced and which forms a complete kit.

According to this present invention a price ticket or like display assembly comprises; (a) a transparent support panel which is sufficiently resilient to be flexed for insertion into a channeled ticket holder and which on release springs back, whereby the marginal opposed side portions locate within the jaws of parallel channels of said ticket holder, the panel having printed thereon display matter but with at least one area left clear to form a window, the support panel, at least in each window area on the side adjacent to the ticket holder, having a highly polished surface, (b) components of soft plastic material having a highly polished surface, each component, conveying an item of information, so designed to be positioned within, adhere to and be readable through a particular window, (c) a setting panel comprising a rigid board, printed with the outline of the location zones for each self-adherent component, each zone having associated therewith a discrete area to which the selected component may be temporarily adhered.

Preferably the ticket holder will have a convex or concave shaped surface whereby the support panel, following engagement with the channels springs into close contact with the surface of the ticket holder. This provides good support and securement and reduces the probability of interference.

The setting panel may conveniently be included as part of the display kit, this comprising a rigid, or flexible, board printed with the outline of the location zones for each self-adherent component. Each zone having associated therewith a discrete area of, for example, a highly polished material or adhesive to which the selected component may be temporarily adhered. The assembly of setting panel and components can then be overlaid with the support panel in correct alignment, and firm pressure applied to the latter then causes the components to adhere thereto. Removal of the support panel away from the setting panel causes the components to be plucked from the setting panel by virtue of the relatively substantial area of adhesion with the support panel as compared with the small areas of adhesion with the setting panel.

To produce the transparent support panels sheets of any suitable material can be used, preference being given to plastics materials which are resilient enough to flex easily and yet capable of springing back to the original form without permanent deformation. For example certain grades of polyvinylchloride, polystyrene or cellulose acetate may be used, the selected sheets, for the most part, having both surfaces highly polished. Either surface can be painted or printed preferably with a high gloss finish and with the chosen subject matter, the main background colour of the support is preferably sufficiently opaque to conceal the external outline of the components when in position. This may be achieved as follows: the components (which are applied inside or behind the unmasked areas of the main panels so as to be readable therethrough) are preferably made somewhat larger than the windows they are designed to occupy, thus avoiding leaving exposed or naked areas, the object of such concealment, coupled with the protection afforded by the windows is to reduce the risk of the items being tampered with.

The self-adherent components will preferably be produced from coloured rather than transparent material, the former providing its own background, whereas if the latter material is used a background has to be painted or printed on the components thereby incurring extra cost. The coloured material used needs to be sufficiently opaque to provide an adequate background for the subject matter it conveys which can be painted or printed directly on to one surface thereof. The components are best formed from sheets of soft, polished polyvinylchloride, which, apart from being quite limp and easily handled, can be made to adhere or cohere, of its own accord, to almost any smooth, glazed surface, simply by being pressed into contact therewith.

A preferred method of mass-producing the components, presuming them to be in colour and formed from soft, polished polyvinylchloride sheeting, is as follows:

(1) large sheets of the selected plastics are mounted on to suitable artboard or substantial artpaper, the top or receiving surface of the latter being glazed and the reverse surface matt. As the sheets are thus assembled, they can be piled on top of each other and face up. Stacked in this way, the plastic will be tightly pressed onto the glazed surface of its backing sheet and thus cling firmly thereto but because the reverse side of the backing sheet is matt the assembled sheets will not stick to each other. The plastic material is now unable to stretch or distort and is ready for the next process.

(2) the required subject matter is painted or printed on the sheets keeping to precise register.

(3) The printed sheets are then cut by guillotine into conveniently sized pages with each of these, preferably, containing not one but a whole series of components.

(4) The individual components are then severed and segregated by scoring a kiss-cutting (i.e. platen-cutting), the depth of incision, in either case, being carefully regulated so as to penetrate right through the plastic, yet leave the backing sheet intact.

The backing sheet now serves as a storage sheet, from which the components can be peeled off for positioning on the support panel or setting panel. When the components are taken out of use any surface which at any time was exposed can be wiped clean leaving them in suitable condition for replacement in the appropriate spaces on the storage sheets ready for subsequent re-use. In the case of soft, polished polyvinylchloride components it is possible to preserve them and make them last for a considerable period.

Quite often, a number of storage sheets, each containing a variety of items, will be required to make up a particular set of price tickets. In this event there can be provided an extra cover-page or pages which can be provided with appropriate instructions, the whole then being collected and bound together as an album or punched and placed in a loose leaf binder or file. This, along with the price tickets and any other associated display matter, can be boxed or otherwise suitably packaged and supplied to a user as a complete, self-contained kit.

The main panel may contain several colours but there has to be one which forms the base and certain components can be of a colour which will stand out in contrast thereto, others being chosen to blend therewith or, alternatively, made to match. The information to be conveyed by these components will preferably be silk-screen printed and by employing a minimum of colour-runs an attractive, multicolour display can be created.

Figure 2:
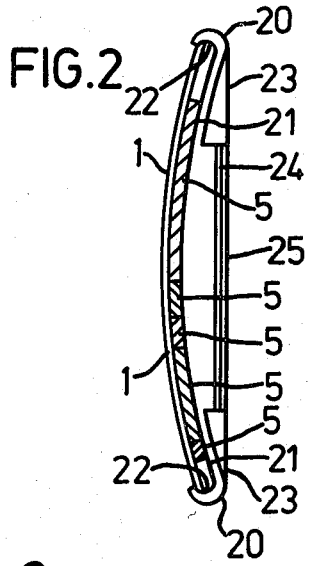
Figure 3:
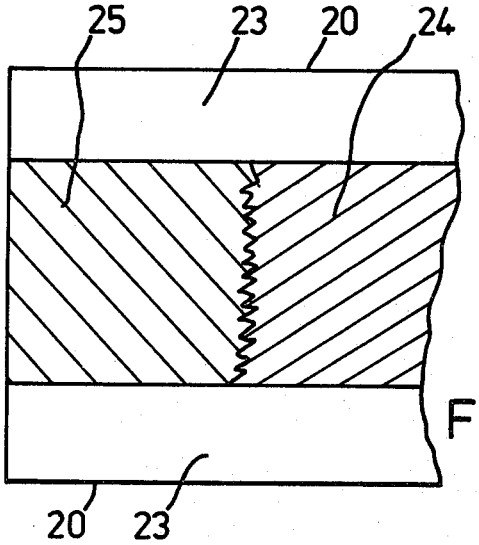

Reference will now be made to the accompanying drawings wherein the invention is explained further with reference to preferred embodiments as examples. In the drawings:

FIG. 1 shows an assembled support panel viewed from the front with several self adhesive components in position, FIG. 2 shows a section through the panel located in position in a channelled ticket holder, FIG. 3 shows a fragmentary rear view of a ticket holder, FIGS. 4 to 6 show three further ticket holders in rear perspective view, and FIGS. 7 to 11 show the main steps in making up a support panel and components using a setting panel.

Referring to the drawings FIG. 1 shows a price ticket which primarily is designed for use in a channelled holder of the kind used for shelf-pricing in stores and supermarkets and so forth such a holder being shown in FIG. 2 in section. The support panel 1 is produced from a semi-rigid, transparent polyvinylchloride sheet the thickness being such as to give sufficient resilience to be flexed fairly easily for insertion in the holder and when released, to spring out and secure itself between the opposed lips of the channels of the holder. Printed in high gloss finish, on the back of the support 1 and covering a large part of the surface, are two colours: the first to be applied 2, being for example green, predominates and forms the main background, the other 3, for example opaque white generally following the same register, the purpose being to back up the green 2 and give it extra body and also to extend over and fill in areas such as at top left, hitherto left blank, to spell out the legend "PRODUCE OF". Certain areas 4 of the support panel 1 are left clear, these serving as windows. Applied behind each window is a soft, polished polyvinylchloride component 5, some may be produced from coloured material for example 6, others from a white material 7, the information on the component 6 may be painted or printed in black 8 and on the components 7, in red 9. This gives a ticket which as a whole, is colourful and eye-catching. The polyvinylchloride components 5 are made somewhat larger all round than the windows 4 they occupy whereby their outline 10 is concealed by the opaque surrounds 11. A further preferred feature is that in the window 4 on the right are two polyvinylchloride components 5, 5$^1$ which abut each other at 12 along precision-cut sides. If it were required to price the items differently, for example: "per 100 g", "per kg", "each" and so forth, the major component 5, containing the price, could be shifted to fit in the bottom part of the window 4, the appropriate smaller part 5$^1$ giving the quantity of goods on offer, then being abutted to it 5, in the upper part of window 4. An alternative is to provide a division between the two parts of the windows.

FIG. 2 shows to an enlarged scale an end view of a ticket similar to FIG. 1, clinging to which are some polyvinylchloride components 5, the assembled ticket 1 is inserted into an extruded, high-impact polystyrene ticket holder 20. The front surface 21 of the ticket-holder 20 is convex in section, although it could be concave. Channels 22 extend the length of the top and bottom edges. The convex surface 21 keeps the ticket 1 flexed, the stress thus produced causing it to be retained within the jaws of the channels 21, and at the same time, ensuring that the components 5 remain against the ticket and protected at both the front and the back.

The rear surface 23 of the ticket-holder 20 is flat and applied to this in a central position and extending the full length thereof is a strip of a self-adhesive material 24, covered with siliconised release-paper 25, the latter serves as a temporary backing which is peeled away when the ticket-holder 20 is to be applied and secured to a shelf.

FIG. 3 shows a rear view of the ticket-holder 20, of FIG. 2.

FIGS. 4 to 6 show other types of channelled ticket-holders each having a convex main surface 40 against which the support panel bears and opposed channels 41 to receive the edges of the support panels. FIG. 4 has a spring metal clip means 42 which can be compressed and then released to engage with channelling on a shelf or the fitment swivels sideways to engage the mesh of a wire basket whereas FIG. 5 has a spring hook 43 to fit over the top rail of a wire basket for example. In FIG. 6 the ticket holder has integral rear strips 44 which are for full length engagement with a shelf channel.

FIGS. 7 to 11 show a setting panel for a slightly different configuration of windows in the support panel and stages in making-up the panel. The setting panel can for example comprise a rigid cardboard sheet 70 on which outlines 71 are printed to indicate the co-relative positioning of the transparent window portions in the support panel (1) and hence the correct locations of each of the self adhesive components (5). The setting panel also indicates by means of legends 72 the information to be housed within the outlines 71, each outline in this presentation is of a different size to ensure the correct location of the relevant type of information component. Within each outline 71 a discrete spot 73 of a highly polished material or substance is provided, the object of this being to provide partial adhesion of a selected component 5 when same is correctly positioned as indicated on the setting panel, (see FIG. 8), and then pressed down in the centre. This adhesion may be confined simply between the appropriate portion of the highly polished rear surface of each component 74 and the respective spot 73.

The next step (FIG. 9) is to position the relevant support panel 2 over the components 5 on the setting panel ensuring correct alignment within the transparent windows 4 and then to rub the panel 2 firmly down all over so as to gain a sufficient area of adhesion to the components to enable them to be picked up from the setting panel (FIG. 10). The panel may then be removed, the components are thereby being plucked away from the spots 73, by virtue of the relatively small surface area as compared with the window surface.

The panel can then be flexed and placed in the holder 20 and then released to spring back and engage within the jaw of the holder shown in FIG. 11.

I claim:

1. A price ticket or like assembly comprising in combination:

(a) a transparent support panel which is sufficiently resilient to be flexed, a ticket holder including parallel channels into which said panel is inserted and springs back upon release, whereby opposing edge portions of said panel locate within said parallel channels of said ticket holder, said panel having display matter printed thereon but with at least one area left clear to form a window, said support panel having, at least in each window area on the side adjacent to the ticket holder, a highly polished surface.

(b) components of soft plastic material having a highly polished surface, each component being self-adherent, positioned within and conveying an item of information and readable through a particular window, (c) a setting panel comprising a rigid board, printed with an outline defining a location zone for each self-adherent component, each zone having associated therewith a discrete area to which the selected component is temporarily adhered, whereby when the side of the support panel normally adjacent the ticket holder is brought into surface-to-surface contact with the setting panel having components adhered thereon, application of pressure causes the surface of each component on the setting panel to adhere to a particular window of the support panel, removal of the support panel from the setting panel causing the components to be plucked from the setting panel and to remain adhered to the support panel.

2. An assembly as claimed in claim 1, wherein the areas of adhesion on the setting panel are substantially smaller than the areas of adhesion between each component and the support panel.

3. A marchandise price ticket or like display assembly comprising in combination:

(a) a transparent support panel which is sufficiently resilient to be flexed for insertion into a channeled ticket holder and which on release springs back, whereby opposing edge portions locate within parallel channels of said ticket holder, the panel having printed thereon display matter but with at least one area left clear to form a window, the support panel having, at least in each window area on the side adjacent to the ticket holder, a highly polished surface, (b) components of soft plastic material having a highly polished surface which when brought into face-to-face contact with a highly polished rear surface of a window in the panel will adhere thereto, said components having printed second display matter thereon, (c) a setting panel having printed thereon boundaries forming locating areas in co-alignment with the window areas of the support panel, each said locating area containing a zone of highly polished material, to which the rear of a component will adhere, the adhesion between the said zone and the rear of the component being less than the adhesion between the front of the component and the rear of the window, whereby when the side of the support panel normally adjacent the ticket holder is brought into surface-to-surface contact with the setting panel having components adhered thereon, application of pressure causes the surface of each component on the setting panel to adhere to a particular window of the support panel, removal of the support panel from the setting panel causing the components to be plucked from the setting panel and to remain adhered to the support panel.

4. An assembly according to claim 3, wherein the said zone comprises a highly polished spot, which adheres to a component, within the said locating area of the setting panel, which area is otherwise non-adherent to the component.

5. An assembly according to claim 3, wherein the support panel is a hard but flexible plastic material with highly polished surfaces and the components comprise a soft limp material with highly polished surfaces, the materials exhibiting adherence properties on the surfaces.

* * * * *